US005525449A

United States Patent [19]

Spiewak et al.

[11] Patent Number: 5,525,449

[45] Date of Patent: Jun. 11, 1996

[54] LIQUID DEVELOPER COMPOSITIONS WITH ALCOHOL

[75] Inventors: John W. Spiewak, Webster; James R. Larson, Fairport, both of N.Y.

[73] Assignee: Xerox Corporation, Stamford, Conn.

[21] Appl. No.: 314,752

[22] Filed: Sep. 29, 1994

[51] Int. Cl.[6] ..... G03G 9/135

[52] U.S. Cl. ..... 430/115; 430/112; 430/137

[58] Field of Search ..... 430/112, 115, 430/137

[56] References Cited

U.S. PATENT DOCUMENTS

| | | | |
|---|---|---|---|
| 4,707,429 | 11/1987 | Trout | 430/115 |
| 5,019,477 | 5/1991 | Felder | 430/115 |
| 5,030,535 | 7/1991 | Drappel et al. | 430/116 |
| 5,266,435 | 11/1993 | Almog | 430/115 |
| 5,306,591 | 4/1994 | Larson et al. | 430/115 |
| 5,308,731 | 5/1994 | Larson et al. | 430/115 |
| 5,441,841 | 8/1995 | Larson | 430/115 |

*Primary Examiner*—Kathleen Duda
*Attorney, Agent, or Firm*—E. O. Palazzo

[57] ABSTRACT

A liquid developer comprised of a liquid, thermoplastic resin particles, pigment, and a charge director containing an alcohol.

36 Claims, No Drawings

LIQUID DEVELOPER COMPOSITIONS WITH ALCOHOL

BACKGROUND OF THE INVENTION

This invention is generally directed to liquid developer compositions and, in particular, to a liquid developer containing a charge director containing an alcohol as a cosolvent. The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after extensive research efforts, and which toners result in, for example, sufficient particle charge for transfer and maintain the mobility within the desired range of the particular imaging system employed. Advantages associated with the present invention include increasing the desired charge on the developer particles and in embodiments providing a charge director, that is superior to similar charge directors, like quaternary ammonium block copolymers, lecithin, and metal salts of petroleum fractions. Some of the aforementioned additives like lecithin contain impurities which can have an adverse effect on their intended function. The superior charge can result in improved image development and superior image transfer, and enable excellent image resolution. Also, with the developers of the present invention containing a charge director, such as a quaternary salt with a cosolvent alcohol, enables increased clarity and increased conductivity in the charge director solutions.

A latent electrostatic image can be developed with toner particles dispersed in an insulating nonpolar liquid. The aforementioned dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Useful liquid developers can comprise a thermoplastic resin and a dispersant nonpolar liquid. Generally, a suitable colorant, such as a dye or pigment, is also present. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 μm average by area size as measured using the Horiba Capa 700 particle sizer.

Since the formation of proper images depends, for example, on the difference of the charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like, to the liquid developer comprising the thermoplastic resin, the nonpolar liquid and the colorant.

U.S. Pat. No. 5,019,477, the disclosure of which is incorporated herein by reference, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate. As the copolymer of polyethylene and methacrylic acid or methacrylic acid alkyl esters, NUCREL® may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995.

The disclosures of each of the U.S. patents mentioned herein are totally incorporated herein by reference.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

in U.S. Pat. No. 5,308,731, the disclosure of which is totally incorporated herein by reference, there is illustrated a liquid developer comprised of a nonpolar liquid, thermoplastic resin particles, a nonpolar liquid soluble ionic or zwitterionic charge director, and a charge adjuvant comprised of an aluminum hydroxycarboxylic acid, or mixtures thereof; U.S. Pat. No. 5,306,591, the disclosure of which is totally incorporated herein by reference, discloses a liquid developer comprised of thermoplastic resin particles, a charge director, and a charge adjuvant comprised of an imine bisquinone; and U.S. Statutory Invention Registration No. H1483, the disclosure of which is totally incorporated herein by reference, discloses a liquid developer comprised of thermoplastic resin particles, and a charge director, which director is one of the preferred components for the developers of the present invention, especially the methyl HBR salt thereof, comprised of an ammonium AB diblock copolymer of the formula

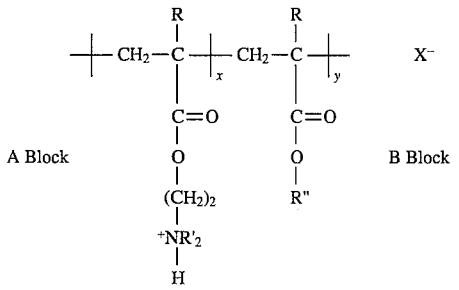

wherein $X^-$ is a conjugate base or anion of a strong acid; R is hydrogen or alkyl; R' is alkyl; R" is an alkyl group containing from about 6 to about 20 carbon atoms; and y and x represent the number average degree of polymerization (DP) wherein the ratio of y to x is in the range of from about 10 to 2 to about 100 to 20.

Illustrated in copending patent applications U.S. Ser. No. 220,860, the disclosure of which is totally incorporated herein by reference, is a positively charged liquid developer comprised of thermoplastic resin particles, pigment, a charge director, and an insoluble charge adjuvant comprised of a polymeric quaternary ammonium compound, and wherein the charge adjuvant is associated with or combined with said resin and said pigment; and U.S. Ser. No. 204,016, now abandoned and refiled as continuation-in-part application U.S. Ser. No. 505,043, the disclosure of which is totally incorporated herein by reference, is a liquid developer comprised of thermoplastic resin particles, optional pigment, and a charge director comprised of a mixture of an organic anioinic complex phosphate ester and organic aluminum complex, or mixtures thereof of the formulas

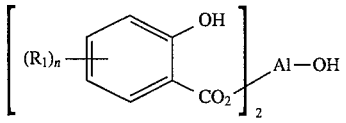

or

-continued

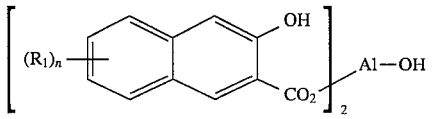

wherein $R_1$ is selected from the group consisting of hydrogen and alkyl, and n represents a number, the disclosure of which is totally incorporated herein by reference.

SUMMARY OF THE INVENTION

Examples of objects of the present invention include:

It is an object of the present invention to provide liquid developers with many of the advantages illustrated herein.

Another object of the present invention is to provide liquid developers capable of high particle charging and rapid toner charging rates.

Another object of the invention is to provide a negatively charged liquid developer wherein there are selected as charge directors quaternary ammonium AB diblock copolymers with hydroxide as the anion, and which director contains an alcohol.

It is still a further object of the invention to provide a liquid developer wherein developed image defects such as smearing, loss of resolution and loss of density are eliminated, or minimized.

It is another object of this invention to provide charge director solutions, and wherein high conductivity and solution clarity are achieved.

Another object of the present invention is to provide a negatively charged liquid developer wherein there are selected as charge directors quaternary ammonium ABA triblock copolymers, and which directors contain an alcohol; and wherein in embodiments the alcohol can be added as a cosolvent in hydrocarbon solution containing a charge director, and subsequently the resulting mixture is utilized to form a liquid ink or liquid developer.

Another object of the invention is to provide a negatively charged liquid developer wherein there are selected as charge directors quaternary ammonium block copolymers which are zwitterions having the cationic and anionic sites coupled, and which director contains an alcohol.

Also, in another object of the present invention there are provided negatively charged liquid developers with certain charge directors containing aliphatic alcohols, which are superior in embodiments to, for example, quaternary ammonium block copolymers since, for example, with the hydroxide anion higher negative particle charge results in embodiments. The superior charge can result in improved image development and excellent image transfer.

Another object of the present invention resides in the provision of negatively charged liquid toners with quaternary ammonium block copolymers which contain aliphatic alcohols to enhance their functionality, and wherein in embodiments enhancement of the negative charge of NUCREL® based toners, especially cyan and magenta toners, is enhanced.

These and other objects of the present invention can be accomplished in embodiments by the provision of liquid developers with charge directors containing alcohols. In embodiments, the present invention is directed to liquid developers comprised of a toner resin, pigment, and a charge director, such as an additive comprised of quaternary ammonium block copolymers with hydroxide as the anion. In embodiments, the aforementioned charge director contains a quaternary ammonium group and a constituent or component that is nonpolar thereby enabling hydrocarbon solubility, and which block copolymers can be obtained by group transfer polymerization.

Of importance with respect to the present invention and to achieve many of the advantages illustrated herein is the addition of an alcohol to the charge director prior to contacting or mixing of the resulting mixture with the toner particles of resin, charge additive, and pigment. Examples of alcohols include branched, linear, and cyclic aliphatic alcohols such as those with from 1 to about 35 carbon atoms, and preferably from 1 to about 10 carbon atoms such as methanol, ethanol, n-proponal, isopropanol, n-butanol, isobutanol, sec-butanol, t-butanol, penantols, hexanols, cycohexanol, 4-methylcyclohexanol, heptanols, octanols, decanol n-dodecanol, hexadecanol, octadecanol, tetracosanol, tricontanol, pentatricotanol, cholesterol, and the like, and wherein the alcohol can be combined with the charge director in an amount range of 2 to 100 millimoles of alcohol per millimole of ionic groups, such as ammonium group, in the charge director.

Embodiments of the present invention relate to a developer comprised of a liquid, thermoplastic resin particles, and a nonpolar liquid soluble ammonium block copolymer charge director; and a liquid electrostatographic developer comprised of (A) a nonpolar liquid having a Kauriobutanol value of from about 5 to about 30, and present in a major amount of from about 50 percent to about 95 weight percent, (B) thermoplastic resin particles having an average volume particle diameter of from about 5 to about 30 microns, (C) a nonpolar liquid soluble ionic or zwitterionic ammonium block copolymer with alcohol cosolvent and (D) optionally a charge adjuvant.

Examples of charge directors of the present invention selected in various effective amounts as indicated herein can be represented by the formula

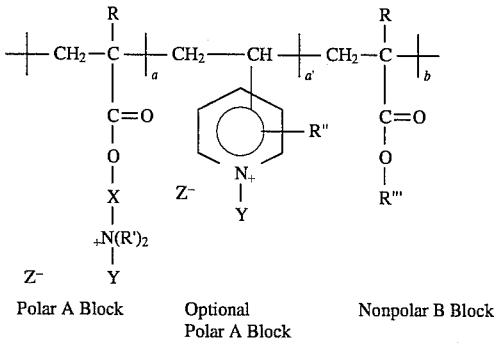

wherein R is hydrogen, alkyl, aryl, or alkylaryl; R" is, alkyl, aryl, cycloalkyl, cycloalkylalkyl, cycloalkylaryl or alkylaryl with or without heteroatoms; R'" is alkyl, aryl, cycloalkyl, cycloalkylalkyl, cycloalkylaryl or alkylaryl of 4 to 20 carbons with or without heteroatoms; X is alkylene or arylalkylene of, for example, about 2 to 10 carbons with or without heteroatoms and Y is hydrogen, alkyl of 1 to about 25 carbon atoms; alkylaryl and aryl from 6 to about 30 carbon atoms with or without heteroatoms; Z– is an anion such as bromide, hydroxide, chloride, nitrate, p-toluenesulfonate, sulfate, phosphate, fluoride, dodecylsulfonate, dodecylbenzenesulfonate, acetate, trifluoracetate, chloroacetate, stearate, and the like; $aM_a+a'M_{a'}$ is about 200 to 120,000 and $bM_b$ is 2,000 to 190,000 wherein a,a', and b is the number average degree of polymerization (DP) and $M_a$, $M_{a'}$, and $M_b$ is the corresponding repeat unit molecular weights. Alkyl includes groups with 1 to about 25 carbon atoms; aryl includes groups with from 6 to about 24 carbon atoms; and alkylene can include groups with from 1 to about 25 carbon atoms.

Examples of specific diblock copolymer charge directors preferably with an Mn of from about 2,200 to about 200,000 include poly[2-trimethylammoniumethyl methacrylate bromide co-2-ethylhexyl methacrylate], poly[2-triethylammoniumethyl methacrylate hydroxide co-2-ethylhexyl methacrylate], poly[2-trimethylammoniumethyl methacrylate chloride co-2-ethylhexyl methacrylate], poly[2-trimethylammoniumethyl methacrylate fluoride co-2-ethylhexyl acrylate], poly[2 -trimethylammoniumethyl acrylate p-toluenesulfonate co-2-ethylhexyl methacrylate], poly[2-trimethylammoniumethyl acrylate nitrate co-2 -ethylhexyl acrylate], poly[2-triethylammoniumethyl methacrylate phosphate co-2-ethylhexyl acrylate], poly[2-triethylammoniumethyl acrylate bromide co-2-ethylhexyl acrylate], poly[2 -trimethylammoniumethyl methacrylate hydroxide co-2-ethylhexyl acrylate], poly[2-trimethylammoniumethyl acrylate hydroxideco-2-ethylhexyl acrylate], poly[2-trimethylammoniumethyl methacrylate hydroxide co-N,N-dibutyl methacrylamide], poly[2-triethylammoniumethyl methacrylate chloride co-N,N-dibutyl methacrylamide], poly[2 -trimethylammoniumethyl methacrylate bromide co-N,N-dibutylacrylamide], poly[2-triethylammoniumethyl methacrylatehydroxide co-N,N-dibutylacrylamide], poly[2-dimethylammoniumethyl methacrylate bromide co-2-ethylhexyl methacrylate], poly[2-dimethylammoniumethyl methacrylate tosylate co-2-ethylhexyl methacrylate], poly[2 -dimethylammoniumethyl methacrylate chloride co-2-ethylhexyl methacrylate], poly[2-dimethylammoniumethyl methacrylate bromide coo2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate, poly[2 -dimethylammoniumethyl acrylate tosylate co-2-ethylhexyl acrylate], poly[2 -dimethylammoniumethyl methacrylate chloride co-2-ethylhexyl acrylate], poly[2-dimethylammoniumethyl acrylate chloride co-2-ethylhexyl acrylate], poly [2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], and poly[2 -dimethylammoniumethyl methacrylate tosylate co-N,N-dibutylacrylamide].

Other examples of suitable diblock copolymer charge directors include poly[4-vinyl-N,N-dimethylanilinium bromide co-2-ethylhexyl methacrylate], poly[4-vinyl-N,N-dimethylanilinium tosylate co-2-ethylhexyl methacrylate], poly [ethylenimmonium bromide co-2-ethylhexyl methacrylate], and poly[propylenimmonium bromide co-2-ethylhexyl methacrylate].

Further examples of diblock copolymer charge directors include poly[4-vinyl-N,N-trimethylanilinium bromide co-2-ethylhexyl methacrylate], poly[4-vinyl-N,N-triethylanilinium chloride co-2-ethylhexyl methacrylate], poly[quaternary ethylenimmonium fluoride co-2-ethylhexyl methacrylate], poly[quaternary propylenimmonium hydroxide co-2-ethylhexyl methacrylate], and polyvinyl-N-ethylpyridinium nitrate-co-p-dodecylstyrene.

Preferred ammonium AB diblock copolymer charge directors of this invention contains a polar A block with a positively charged ammonium nitrogen and a nonpolar B block which has sufficient aliphatic content to enable the block copolymer to more effectively dissolve in a nonpolar liquid having a Kauri-butanol value of less than about 30. The A block has, for example, a number average molecular weight range of from about 200 to about 120,000 and the B block has a number average molecular weight range of from about 2,000 to about 190,000. Number average degree of polymerization (DP) refers to the average number of monomeric units per polymer chain. It is related to the number average molecular weight ($M_n$) by the formula $M_n=M_0 \times DP$, where $M_0$ is the molecular weight of the monomer. Amine nitrogen alkylation to form the ammonium salt in the polar A block for excellent charge director performance is in embodiment at least 80 mole percent and preferably at least 90 mole percent.

In another embodiment, the AB ammonium diblock charge director is composed of A and B blocks, wherein the A block is an alkyl, aryl or alkylaryl amine containing polymer wherein the alkyl, aryl, or alkylaryl moiety which can be substituted or unsubstituted. Useful A blocks are polymers prepared from at least one monomer selected from the group consisting of 1) $CH_2{=}CRCO_2R^1$ wherein R is hydrogen, alkyl, aryl, or alkylaryl of 1 to 20 carbons and $R^1$ is alkyl of 1 to 20 carbons where the terminal end of $R^1$ is of the general formula —$N(R^2)_3X$— where N is nitrogen, $R^2$ is alkyl, cycloalkyl, aryl, or alkylaryl of 1 to 20 carbons, X— is an anion such as OH—, Cl—, Br—, p-toluene sulfonate, dodecylsulfonate, nitrate, phosphate, and the like; and 2) 2, 3, or 4-vinylpyridinium salt wherein the ring carbon atoms not substituted with the vinyl group are substituted with $R^2$ and the ring nitrogen is substituted with R as defined above. Examples of monomers useful as A blocks include 2-(N,N-trimethylammonium hydroxide)ethyl methacrylate, 2-(N,N-triethylammonium bromide)ethyl methacrylate, 2-(N,N-trimethylammonium chloride)ethyl acrylate, 2-(N,N-trimethylammonium p-toluene-sulfonate)ethyl methacrylate, 4-vinyl-N-methyl-pyridinium p-toluene sulfonate, 2-vinyl-N-ethyl-pyridinium acetate-3-vinyl-N-methyl-pyridinium bromide, and the like. Useful B blocks are polymers prepared from at least one monomer selected from the group consisting of butadiene, isoprene, and compounds of the general formulas, $CH_2{=}CHR^3$, $CH_2{=}CHCO_2R^3$, $CH_2{=}CRCO_2R^3$, where $R^3$ is alkyl of about 6 to about 30 carbons, or alkylaryl of 8 to 30 carbons. Examples of monomers useful in preparing B blocks include 2-ethylhexylmethacrylate, laurylmethacrylate, stearylmethacrylate, butadiene, isoprene, 1-dodecene, 2-ethylhexylacrylate, p-tert butylstyrene, and the like. Aryl includes 6 to about 30 carbon atoms, such as phenyl, benzyl, naphthyl and the like, and alkyl includes methyl, ethyl, propyl, butyl, pentyl, and the like.

Other suitable nonpolar liquid soluble charge director compound examples selected for the developers of the present invention in various effective amounts, such as from about 0.5 to about 100 weight percent of developer solids, which is also represented as 5 milligrams to 1,000 milligrams of charge director solids to 1 gram of developer solids, and preferably 1 percent to 20 percent by weight relative to developer solids, which is also referred to as 10 milligrams to 200 milligrams of charge director solids to 1 gram of developer solids, include zwitterionic AB diblock copolymers represented by the following formula

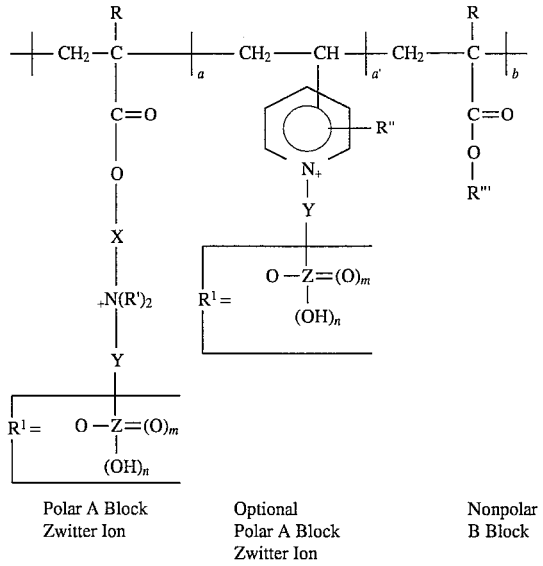

wherein R is hydrogen, alkyl, aryl, or alkylaryl; $R^1$ is a conjugate oxygen containing acid anion derived from carbon, sulfur, or phosphorus; Z is carbon (C), sulfur (S), phosphorus (P), or substituted phosphorus (P-R with R defined as above); m is 1 or 2 doubly bonded oxygen atoms; and n is 0 or 1 hydroxyl groups; R' is alkyl, aryl, cycloalkyl, cycloalkylenyl cycloalkylalkyl, cycloalkylaryl or alkylaryl with or without heteroatoms; R" is alkyl, aryl, cycloalkyl, cycloalkylalkyl, cycloalkylaryl or alkylaryl with or without heteroatoms; R'" is alkyl, aryl, cycloalkyl, cycloalkylalkyl, cycloalkylaryl or alkylaryl of 4 to 20 carbons with or without heteroatoms; X is alkylene or arylalkylene of, for example, about 2 to 10 carbons with or without heteroatoms and Y is alkylene or arylalkylene of 1 to 10 carbons with or without heteroatoms; $aM_a+a'M_{a'}$ is about 200 to 120,000 and $bM_b$ is 2,000 to 190,000 wherein a,a', and b is the number average degree of polymerization (DP) and $M_a$, $M_{a'}$, and $M_b$ is the corresponding repeat unit molecular weights. Alkyl includes groups with 1 to about 25 carbon atoms; aryl includes groups with from 6 to about 24 carbon atoms; and alkylene can include groups with from 1 to about 25 carbon atoms.

Examples of specific zwitterionic diblock copolymer charge directors include poly(2-ethylhexyl methacrylate-co-N,N-dimethyl-N-methylenecarboxylate-N-ammoniumethyl methacrylate), poly(2-ethylhexyl methacrylate-co-N,N-dimethyl-N-propylenesulfonate-N-ammoniumethyl methacrylate), poly(2-ethylhexyl methacrylate-co-N,N-dimethyl-N-propylenephosphonate-N-ammoniumethyl methacrylate), poly(2 -ethylhexyl methacrylate-co-N,N-dimethyl-N-propylenephosphinate-N-ammoniumethyl methacrylate), poly(2-ethylhexyl methacrylate-co-N,N-dimethyl-N-propylenesulfinate-N-ammoniumethyl methacrylate), poly(2 -ethylhexyl methacrylate-co-N,N-diethyl-N-methylenecarboxylate-N-ammoniumethyl methacrylate), poly(2-ethylhexyl methacrylate-co-N,N-diethyl-N-propylenesulfonate-N-ammoniumethyl methacrylate), poly(2-ethylhexyl methacrylate-co-N,N-dimethyl-N-butylenephosphonate-N-ammoniumethyl methacrylate), poly(2-ethylhexyl methacrylate-co-N,N-dimethyl-N-decamethylenephosphonate-N-ammoniumethyl methacrylate), poly(2-ethylhexyl methacrylate-co-N,N-dimethyl-N-decamethylenephosphinate-N-ammoniumethyl methacrylate), poly(2-ethylhexyl methacrylate-co-N,N-dimethyl-N-butylenecarboxylate-N-ammoniumethyl methacrylate), poly(2-ethylhexyl methacrylate-co-N,N-dimethyl-N-ethyleneoxyethylenecarboxylate-N-ammoniumethyl methacrylate), poly(2-ethylhexyl methacrylate-co-N,N-dimethyl-N-ethyleneoxyethylenesulfonate-N-ammoniumethyl methacrylate), poly(2-ethylhexyl methacrylate-co-N,N-dimethyl-N-ethyleneoxyethylenephosphonate-N-ammoniumethyl methacrylate), poly(N,N-dibutylmethacrylamido-co-N,N-dimethyl-N-methylenecarboxylate-N-ammoniumethyl methacrylate), poly(N,N-dibutylmethacrylamido-co-N,N-dimethyl-N-propylenesulfonate-N-ammoniumethyl methacrylate), poly(N,N-dibutylmethacrylamido-co-N,N-dimethyl-N-propylenephosphonate-N-ammoniumethyl methacrylate), poly(N,N-dibutylmethacrylamido-co-N,N-dimethyl-N-propylenephosphinate-N-ammoniumethyl methacrylate), and poly(N,N-dibutylmethacrylamido-co-N,N-dimethyl-N-propylenesulfinate-N-ammoniumethyl methacrylate). In all of the above examples, the corresponding acrylate copolymer, instead of the methacrylate copolymer, could also be employed as suitable nonpolar liquid soluble zwitterionic AB diblock copolymer charge directors. Additional suitable examples of nonpolar liquid soluble zwitterionic AB diblock copolymer charge directors include poly(4-vinylpyridinium-N-methylenecarboxylate-co-2-ethylhexyl methacrylate), poly(4-vinylpyridinium-N-propylenesulfonate-co-2-ethylhexyl methacrylate), poly(4-vinylpyridinium-N-propylenephosphonate-co- 2-ethylhexyl methacrylate), poly(4 -vinylpyridinium-N-propylenephosphinate-co-2-ethylhexyl methacrylate), poly(4-vinylpyridinium-N-propylenesulfinate-co-2-ethylhexyl methacrylate), poly(4-vinylpyridinium-N-ethyleneoxyethylenecarboxylate-co- 2-ethylhexyl methacrylate), poly(4-vinylpyridinium-N-ethyleneoxyethylenesulfonate-co- 2-ethylhexyl methacrylate), poly(4 -vinylpyridinium-N-ethyleneoxyethylenephosphonate-co-2-ethylhexyl methacrylate), poly(4-vinylpyridinium-N-methylenecarboxylate-co-p-tert butylstyrene), and the like. In the aforementioned pyridinium examples, additional examples of nonpolar liquid soluble zwitterionic AB diblock copolymer charge directors include poly(2-vinylpyridinium-N-methylenecarboxylate-co- 2-ethylhexyl methacrylate), poly(2 -vinylpyridinium-N-propylenesulfonate-co-2-ethylhexyl methacrylate), poly(2-vinylpyridinium-N-propylenephosphonate-co-2-ethylhexyl methacrylate), poly(2-vinylpyridinium-N-propylenephosphinate-co-2-ethylhexyl methacrylate), poly(2-vinylpyridinium-N-propylenesulfinate-co-2-ethylhexyl methacrylate), poly(2-vinylpyridinium-N-ethyleneoxyethylenecarboxylate-co- 2-ethylhexyl methacrylate), poly(2 -vinylpyridinium-N-ethyleneoxyethylenesulfonate-co-2-ethylhexyl methacrylate), poly(2-vinylpyridinium-N-ethyleneoxyethylenephosphonate-co-2-ethylhexyl methacrylate), poly[3 -vinylpyridinium-N-methylenecarboxylate-co-p-tert. butylstyrene) and poly(3-vinylpyridinium-N-methylenecarboxylate-co-2-ethylhexyl methacrylate), poly(3-vinylpyridinium-N-propylenesulfonate-co-2-ethylhexyl methacrylate), poly(3-vinylpyridinium-N-propylenephosphonate-co- 2-ethylhexyl methacrylate), poly(3 -vinylpyridinium-N-propylenephosphinate-co-2-ethylhexyl methacrylate), poly(3-vinylpyridinium-N-propylenesulfinate-co-2-ethylhexyl methacrylate), poly(3-vinylpyridinium-N-ethyleneoxyethylenecarboxylate-co- 2-ethylhexyl methacrylate), poly(3-vinylpyridinium-N-ethyleneoxyethylenesulfonate-co- 2-ethylhexyl methacrylate), poly(3 -vinylpyridinium-N-ethyleneoxyethylenephosphonate-co-2-ethylhexyl methacrylate), poly(3-vinylpyridinium-N-methylenecarboxylate-co-p-tert butylstyrene), and the like.

The preferred repeat unit content of the polar A block is 60 to 5 mole percent and is more preferably at 40 to 10 mole percent, and the preferred repeat unit content of the nonpolar B block is 40 to 95 mole percent and is more preferably at 60 to 90 mole percent. Amine nitrogen alkylation to form the zwitterionic ammonium polar A block repeat unit wherein both cationic and anionic sites are covalently bonded within the same polar repeat unit should be at least 80 mole percent and preferably at least 90 mole percent for satisfactory charge director performance. The polar A block may be comprised entirely of either of the polar blocks illustrated herein or it may be complex wherein the optional polar A block repeat unit may be 0.1 to 99.9 mole percent of all the polar A block repeat units present. The complex polar A block may be segmented, tapered or random when it contains more than one repeat unit.

In another embodiment the AB zwitterionic ammonium diblock charge director is composed of A and B blocks as described hereinafter. The polar A block is an alkyl, aryl or alkylaryl amine containing polymer wherein the alkyl, aryl, or alkylaryl moiety can be substituted or unsubstituted, and be cyclic or noncyclic. Useful A blocks are polymers prepared from at least one monomer selected from the group consisting of 1) $CH_2{=}CRCO_2R^1$ wherein R is hydrogen, alkyl, aryl, or alkylaryl, and $R^1$ is a conjugate acid monoanion wherein m=0 to 2 and n=0 to 2 and Z is carbon, sulfur, or phosphorus. Specific examples of $R^1$ groups include carboxylate, sulfonate, sulfinate, phosphonate, phosphinate, phosphate and sulfate. X and Y are alkylene or arylalkylene with or without heteroatoms wherein Z contains 2 to 10 carbon atoms and Y contains 1 to 10 carbon atoms. Examples of X groups include 1,2-ethylene, 1,3-propylene, 1,2-propylene, 1,4-butylene, 1,6-hexylene, 1,10-decamethylene, 3,3,5,5-tetramethylhexylene, 1,4-cis or trans dimethylenecyclohexylene, 1,4-phenylenedimethylene, and 1-ethyleneoxy-5-ethylene. Examples of Y groups include methylene, 1-ethylene-2-oxy and all of the above cited X groups. R' is alkyl, aryl, cycloalkyl, cycloalkylenyl, cycloalkylalkyl, cycloalkylaryl or alkylaryl of 1 to 20 carbons with or without heteroatoms. Suitable R' groups include methyl, ethyl, allyl, hexyl, lauryl, cetyl, stearyl, 2-ethoxyethyl, benzyl, phenethyl, 1-methylenenaphthyl, cyclohexyl, cyclohexylmethylene, cyclopentylene, cyclohexylene, 4-ethylcyclohexyl, 4-cyclohexylbenzyl, 4-ethylbenzyl, 4-methoxybenzyl, and 4-nitrobenzyl. R" is alkyl, aryl, cycloalkyl, cycloalkylalkyl, cycloalkylaryl or alkylaryl with or without heteroatoms. Suitable R" groups include methyl, ethyl, allyl, butyl, isoamyl, methoxyl, phenyl, benzyl and cyclohexyl.

Examples of polar A block monomers, selected in the preferred monomer range of 60 to 5 mole percent, which after copolymerization to unquaternized A block precursors that are subsequently quaternized to zwitterionic quaternary ammonium polar A block copolymers, include N,N-dimethylamino-N- 2-ethylmethacrylate, N,N-diethylamino-N-2-ethylmethacrylate, N,N-dimethylamino-N-2-ethylacrylate, N,N-diethylamino-N- 2-ethylacrylate, N-morpholino-2-ethyl methacrylate, 4-vinylpyridine, 3-vinylpyridine, and 2-vinylpyridine. Examples of monomers which after copolymerization give useful A blocks directly include N,N,dimethyl-N-methylenecarboxylate-N-ammoniumethyl methacrylate, N,N-diethyl-N-methylenecarboxylate-N-ammoniumethyl methacrylate, N,N-dimethyl-N-propylenesulfonate-N-ammoniumethyl methacrylate, N,N,dimethyl-N-methylenecarboxylate-N-ammoniumethyl acrylate, N,N-dimethyl-N-propylenesulfonate-N-ammoniumethyl acrylate, N,N-dimethyl-N-butylenephosphonate-N-ammoniumethyl methacrylate, N,N-dimethyl-N-butylenephosphinate-N-ammoniumethyl methacrylate, N,N-morpholino-N-methylenecarboxylate-N-ammoniumethyl methacrylate, N,N-morpholino-N-propylenesulfonate-N-ammoniumethyl methacrylate, 4-vinyl-N-methylene pyridinium carboxylate, 4-vinyl-N-propylenepyridinium sulfonate, 4-vinyl-N-butylenepyridinium phosphonate, 2-vinyl-N-methylene pyridinium carboxylate, 3-vinyl-N-methylene pyridinium carboxylate, and the like Examples of nonpolar B block monomers, selected in the preferred range of 40 to 95 mole percent, provide polymers prepared from at least one B block monomer selected from the group consisting of butadiene, isoprene, chloroprene, mycrene, and compounds of the general formulas $CH_2{=}CHR'''$, $CH_2{=}CHCO_2R'''$, $CH_2{=}CRCO_2R'''$, where R''' is alkyl, aryl, cycloalkyl, cycloalkylalkyl, cycloalkylaryl or alkylaryl with or without heteroatoms of 4 to 20 carbons. Examples of monomers useful in preparing the B blocks include 2-ethylhexyl methacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, chloroprene, mycrene, 1-dodecene, p-tert butylstyrene, and the like. Optional useful nonpolar B blocks are polymers prepared from at least one monomer selected from the group consisting of $CH_2{=}CHCON(R')_2$ and $CH_2{=}CRCON(R')_2$ where R and R' are as indicated herein.

In embodiments, the AB quaternary ammonium hydroxide diblock charge director can be generated by an ion exchange method where the hydroxide ion is substituted for another anion such as bromide, chloride, or p-toluenesulfonate, which can be accomplished by a number of known processes including ion exchange columns and liquid-liquid ion exchange.

The A and B blocks can also be configured into an ABA structure. Examples of ABA triblock copolymer charge directors include poly[N,N-dimethyl-2-aminoethylmethacrylate hydrogen bromide (A block) co-2-ethylhexyl methacrylate (B block)-co-N,N-dimethyl-2-aminoethylmethacrylate hydrogen bromide (A block)], poly[N,N,N-trimethyl- 2-ammoniumethylmethacrylate bromide (A block) co-2-ethylhexyl methacrylate (B block)-co-N,N-trimethyl-2-ammoniumethylmethacrylate bromide (A block)], poly[N,N-dimethyl-N-methylenecarboxylate-N-ammoniumethyl methacrylate (A block)-co-2-ethylhexyl methacrylate (B block)-co-N,N-dimethyl-N-methylenecarboxylate-N-ammoniumethyl methacrylate (A block)], and poly[N,N-dimethyl-N-propylenesulfonate-N-ammoniumethyl methacrylate-co-2-ethylhexyl methacrylate (B block)-co-N,N-dimethyl-N-propylenesulfonate-N-ammoniumethyl methacrylate (A block)].

The charge director with alcohol can be selected for the liquid developers in various effective amounts, such as for example from about 0.5 percent to 100 percent by weight relative to developer solids and preferably 2 percent to 20 percent by weight relative to developer solids. Developer solids include in embodiments toner resin, pigment, and optional charge additive. Without pigment, the developer may be selected for the generation of a resist, or a printing plate.

Examples of liquid carriers selected for the developers of the present invention include a liquid with an effective viscosity of, for example, from about 0.5 to about 500 centipoise, and preferably from about 1 to about 20 centipoise, and a resistivity greater than or equal to $5\times10^9$ ohm/centimeter, such as $10^{13}$ ohm/centimeter or more. Preferably, the liquid selected in embodiments is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of about $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR™ series available from Exxon Corporation, the SOLTROL® series from the Phillips Petroleum Company, and the SHELLSOL® series from the Shell Oil Company can be selected. Other fluids such as USP light mineral oils, such as the SUPERLA® series of mineral oils available from the Amaco Oil Company are suitable.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight.

Various suitable thermoplastic toner resins can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge director, and any other optional components that comprise the particles. Examples of such resins include ethylene vinyl acetate (EVA) copolymers (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid and at least one alkyl ester of acrylic or methacrylic acid wherein alkyl is from 1 to about 20 carbon atoms like methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL® like NUCREL® 599, NUCREL® 699, or NUCREL® 960 are selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 20 percent by weight based on the total weight of solids contained in the developer. The amount of colorant used may vary depending on the use of the developer. Examples of colorants include pigments such as carbon blacks like REGAL 330®, cyan, magenta, yellow, blue, green, brown and mixtures thereof; pigments as illustrated in U.S. Pat. No. 5,223,368, the disclosure of which is totally incorporated herein by reference, and more specifically, the following.

| PIGMENT BRAND NAME | MANU-FACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |

-continued

| PIGMENT BRAND NAME | MANU-FACTURER | COLOR |
|---|---|---|
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI 77266 |
| UHLICH ® BK 8200 | Paul Uhlich | Black |

To further increase the toner particle charge and, accordingly, increase the mobility and transfer latitude of the toner particles, known charge adjuvants in effective amounts of, for example, from 0.2 to 5 weight percent of solids of resin, pigment and charge adjuvant can be added to the toner particles. For example, adjuvants, such as metallic soaps like aluminum, magnesium stearate or octoate; fine particle size oxides, such as oxides of silica, alumina, titania, and the like; paratoluene sulfonic acid, and polyphosphoric acid, may be added. Negative charge adjuvants increase the negative charge of the toner particle, while the positive charge adjuvants increase the positive charge of the toner particles. Effective negative charge adjuvants include metal soaps, such as aluminum stearate, Alohas and the like.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is needed for effective image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions since the measurements can be made at high volume loadings, for example, greater than or equal to 1.5 to 10 weight percent. Measurements made by this technique have been shown to correlate with image quality, for example high mobilities can lead to improved image density, higher image resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin and colorant in a manner that the resulting mixture contains, for example, about 15 to about 30 percent by weight of solids; heating the mixture to a temperature from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; diluting the dispersion; and thereafter adding the charge director containing the alcohol.

In the initial mixture, the resin, colorant and optional charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch, or about 1.0 to about 13 millimeters.

Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 70° C. to about 130° C., and preferably from about 75° C. to about 110° C. The mixture may be ground in a heated ball mill or heated attritor at this temperature for about 15 minutes to about 5 hours, and preferably about 1 to about 3 hours.

After grinding at the above temperatures, an additional amount of nonpolar liquid may be added to the dispersion. The amount of nonpolar liquid to be added should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like, in a jacket surrounding the mixing vessel. Cooling may be accomplished, for example, in the same vessel, such as the attritor, while simultaneously grinding with particulate media to prevent the formation of a gel or solid mass without stirring to form a gel or solid mass, followed by shredding the gel or solid mass, and grinding by means of particulate media, or with stirring to form a viscous mixture and grinding by means of particulate media. The resin precipitate is cold ground for about 1 to about 36 hours, and preferably 2 to 6 hours. Additional liquid may be added at any step during the preparation of the liquid developer to facilitate grinding or to dilute the developer to the appropriate percent solids needed for developing. Methods for the preparation of toners that can be selected are illustrated in U.S. Pat. Nos. 4,760,009; 5,017,451; 4,923,778 and 4,783,389, the disclosures of which are totally incorporated herein by reference.

The charge director with alcohol can be added preparation of the mixture and preferably is added subsequent to the preparation of this mixture in amounts of from about 5 milligrams per gram of toner solids to about 500 milligrams per gram of toner solids of resin, pigment and optional charge adjuvant, and preferably 20 to 100 milligrams.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer, and fixing of the image.

The invention will further be illustrated in the following nonlimiting Examples, it being understood that these Examples are intended to be illustrative only and that the invention is not intended to be limited to the materials, conditions, process parameters and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of −26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by a Horiba CAPA-700 centrifugal automatic particle analyzer, manufactured by Horiba Instruments, Inc., Irvine, Calif.

Specific embodiments of the invention will now be described in detail. These Examples are intended to be illustrative, and the invention is not limited to the materials, conditions, or process parameters set forth in these embodiments. All parts and percentages are by weight unless otherwise indicated. Control Examples are also provided.

EXAMPLE I

LIQUID TONER PREPARATION 1

One hundred and seventy five (175.0) grams of NUCREL 599®, a copolymer of ethylene and methacrylic acid with a melt index at 190° C. of 500 dg/minute, available from E. I. DuPont de Nemours & Company, Wilmington, Del., 45.4 grams of the cyan pigment PV FAST BLUE™, 6.8 grams of aluminum stearate WITCO 22™, available from Witco Company, and 307.4 grams of NORPAR 15®, carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 86° C. to 96° C. for 2 hours, and cooled by running water through the attritor jacket to 16° C.; an additional 980.1 grams of NORPAR 15® were added, and ground in the attritor for an additional 4.5 hours. An additional 1,530 grams of NORPAR 15® were added, and the mixture was separated by the use of a metal grate from the steel balls yielding a liquid toner concentrate of 7.25 percent solids wherein solids include resin, charge adjuvant, and pigment and 92.75 percent NORPAR 15®. The particle diameter was 1.91 microns average by area as measured with a Horiba Cappa 500.

EXAMPLE II

BASE POLYMER PREPARATION 1

There was selected sequential Group Transfer Polymerization (GTP) of 2-ethylhexyl methacrylate (EHMA) and 2-dimethylaminoethyl methacrylate (DMAEMA) to prepare the AB diblock copolymer precursor poly[2-ethylhexyl methacrylate (B block)-co-N,N-dimethylamino-N-ethyl methacrylate (A block)] of quaternary ammonium block copolymer charge directors with added alcohols.

A 2 liter 3-neck round bottom flask equipped with a magnetic stirring football, an Argon inlet and outlet, and a neutral alumina (150 grams) column (later to be replaced by a rubber septum and then a liquid dropping funnel) was charged through the alumina column, which is maintained under a positive Argon flow and sealed from the atmosphere, with 415 grams (2.093 mole) of freshly distilled 2-ethylhexyl methacrylate (EHMA) monomer. Subsequently, 500 milliliters of freshly distilled tetrahydrofuran solvent, distilled from sodium benzophenone, is rinsed through the same alumina column into the polymerization vessel. Subsequently, the GTP initiator, 26 milliliters of methyl trimethylsilyl dimethylketene acetal (22.31 grams; 0.1280 mole), is syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.1 milliliter of a 0.66 molar solution of tetrabutylammonium acetate (catalyst) in the same dry tetrahydrofuran was syringed into the polymerization vessel. After an additional 1 hour of stirring under Argon, the polymerization temperature peaked at about 50° C. Shortly thereafter, 90 grams (0.572 mole) of freshly distilled 2-dimethylaminoethyl methacrylate (DMAEMA) monomer was dropwise added to the polymerization vessel. The polymerization solution was stirred under Argon for at least 4 hours after the temperature peaked. Then 5 milliliters of methanol were added to quench the live ends of the fully grown copolymer. The above charges of initiator and monomers provided an $M_n$ and average degree of polymerization (DP) for each block. For the EHMA nonpolar B block, the charged Mn was 3243 and the DP was 16.4, and for the DMAEMA polar A block, the charged $M_n$ was 703 and the DP was 4.5. $^1$H-NMR analysis of a 20 percent (g/dl) $CDCl_3$ solution of the copolymer indicated a 77 to 82 mole percent EHMA content and a 18 to 23 mole percent DMAEMA content. GPC analysis was obtained on 100 milligrams of the 1 to 2 gram sample of isolated polymer using three 250×8 millimeters PHENOMENEX PHENOGEL™ columns in series (100, 500, 1,000 Angstrom) onto which was injected a 10 microliter sample of the block copolymer at 1 percent (weight/volume) in THF. The sample was eluted with THF at a flow rate of 1 milliliter/minute and the chromatogram was detected with a 254 nanometers UV detector. GPC analysis indicated the major peak at 14.5 to 19.9 counts to have a polystyrene equivalent number average molecular weight of 3,912 and a weight average molecular weight of 6,222 (MWD of 1.59). Two barely discernible broad low molecular weight peaks were located at 20 to 25.1 and 25.1 to 30 counts.

A small (1 to 2 grams) portion of the AB diblock copolymer can be isolated for GPC and $^1$H-NMR analyses by precipitation into 10 times its solution volume of methanol using vigorous mechanical agitation. The precipitated copolymer was then washed on the funnel with more methanol, and was then dried overnight in vacuo (about 0.5 Torr) at about 50° C.

The bulk of the AB diblock copolymer prepared above was not isolated but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Then, toluene was added to the solid polymeric residue to provide a solution of the block copolymer at various desired solids levels depending, for example, on the amount of toluene added.

EXAMPLE III

BASE POLYMER PREPARATION 2

An AB diblock copolymer, poly(2-ethylhexyl methacrylate-co-N,N-dimethylamino-N-ethyl methacrylate), was prepared as described in Example II using the same polymerization procedure and conditions except the polymerization scale was increased by a factor of three. $^1$H-NMR analysis of a 17.5 percent (grams/dl) $CDCl_3$ solution of an isolated 1 to 2 gram portion of the AB diblock copolymer indicated about a 77 to 78 mole percent EHMA repeat unit content and a 22 to 23 mole percent DMAEMA repeat unit content. GPC analysis, as described in Polymer Preparation 1 of Example II, indicated the major peak at 14.4 to 22.6 counts to have a polystrene equivalent number average molecular weight of 2,253 and a weight average molecular weight of 5,978 (MWD of 2.65). A broad low molecular weight peak was located at 24 to 32 counts.

The bulk of the AB diblock copolymer prepared above was not isolated but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Then, toluene was added to the solid polymeric residue to provide a solution of the block copolymer at any desired solids level, but usually at about 50 weight percent polymer solids. This AB diblock copolymer precursor, poly[2-ethylhexyl methacrylate (B block)-co-N,N-dimethylamino-N-ethyl methacrylate (A block)], was used to prepare quaternary ammonium block copolymer charge directors, with and without added alcohols, in Examples IV and V below.

EXAMPLE IV

CHARGE DIRECTOR PREPARATION 1: WITH AND WITHOUT ADDED ALCOHOLS

Preparation of the methyl bromide quaternized ammonium charge director, poly(2-ethylhexyl methacrylate-co-N,N,N-trimethyl-N-ethyl methacrylate ammonium bromide), from poly(2-ethylhexyl methacrylate-co-N,N-dimethylamino-N-ethyl methacrylate) prepared in Example III and methyl bromide.

To a 1 liter Erlenmeyer flask were added 150 grams of a 50.86 weight percent toluene solution of an AB diblock copolymer prepared in Example III composed of 18.23 weight percent of 2-dimethylaminoethyl methacrylate (DMAEMA) repeat units and 81.77 weight percent of 2-ethylhexyl methacrylate (EHMA) repeat units. The 76.29 grams of AB diblock copolymer in the above toluene solution contained 13.91 grams (0.08846 mole) of DMAEMA repeat units. To this magnetically stirred solution at room temperature were added (1) an additional 207 grams of toluene to give a 21.4 percent copolymer solution, and (2) 46.2 milliliters (0.0924 mole) of a 2 molar solution of methyl bromide in t-butyl methyl ether. The charged mole percent ratio of methyl bromide to DMAEMA repeat units was 104.5 mole percent so that all of the DMAEMA repeat units were targeted for conversion to the methyl bromide quaternized poly(2-ethylhexyl methacrylate-co-N,N-dimethylamino-N-ethyl methacrylate) charge director. After stirring for 21 hours at ambient conditions in a stoppered Erlenmeyer flask, the clear solution was rotoevaporated for 2 hours at 50° to 55° C. and 30 to 50 millimeter Hg to remove the excess methyl bromide and toluene. The solid residue was dried in vacuo at 50° to 55° C. for 2.5 to 3.0 hours at about 0.3 millimeter Hg to provide 89.62 grams (theory 84.69 grams) of solid methyl bromide quaternized charge director containing 4.93 grams (5.5 weight percent) of trapped toluene. $^1$H-NMR analysis indicated no unquaternized DMAEMA repeat units based on the absence of a hydrogen signal for the gem dimethyl group on unquaternized nitrogen. The copolymer composition, based upon quantitative quaternization of the DMAEMA repeat units, was 26.34 weight percent (21.95 mole percent) of methyl bromide quaternized DMAEMA repeat units and 73.66 weight percent (78.05 mole percent) of EHMA repeat units.

A NORPAR 15® solution of charge director, poly(2-ethylhexyl methacrylate-co-N,N,N-trimethyl-N-ethyl methacrylate ammonium bromide), was prepared as follows. To 4.00 grams of the above methyl bromide quaternized ammonium solid charge director, after 9 to 10 weeks ambient storage with release of trapped toluene, were added 396.0 grams of NORPAR 15®, and the mixture was stirred at ambient conditions for 67 hours. The charge director concentration was 1.00 weight percent based on the weight of quaternized base polymer and 0.90 weight percent based on the weight of the corresponding amount (3.60 grams) of prequaternized base polymer. This NORPAR 15® charge director solution, without and with added alcohols present, was used to charge the liquid toner concentrate in Example I to give the cyan liquid toners described in Control 1 and in Example V.

The charge director solutions were formulated as described in Table 1 wherein low, mid, and high levels of methanol, n-butanol, and n-dodecanol were employed as additives in the 1 percent NORPAR 15® charge director solutions. Prior to the addition of alcohols, the 1 percent NORPAR 15® charge director solutions were cloudy, but after allowing the briefly stirred CD solutions containing the alcohols to stand ambiently for 24 hours, some of the CD solutions clarified and others remained cloudy. The appearance of the CD-NORPAR 15®-alcohol solutions after standing for 24 hours is given in Table 1 along with the ambient temperature conductivity value. The weight and molar quantities for the added alcohol and the methyl bromide quaternized dimethylaminoethyl methacrylate (DMAEMA) repeat units (based upon a quantitative conversion of the amine group in each DMAEMA repeat unit to the corresponding trimethylammonium bromide quaternized repeat unit) in the CD block copolymer are also provided in Table 1. Also provided in Table 1 is the molar ratio of added alcohol to methyl bromide quaternized dimethylaminoethyl methacrylate (DMAEMA) repeat units in the charge director block copolymer.

TABLE 1

| Charge Director (CD) No. Appearance and Conductivity ps/cm | CD Solution Weight Grams | mmoles DMAEMA .MeBr Quat Used | Alcohol Used | Alcohol Weight (grams) | mmoles Alcohol | mmoles Alcohol/ mmoles DMAEMA .MeBr Quat RUs |
|---|---|---|---|---|---|---|
| IVA (clear) [215] | 30.01 | 0.313 | $C_1$ | 0.0385 | 1.202 | 3.8 Low |
| IVB (clear) [249] | 30.00 | 0.313 | $C_1$ | 0.0382 | 1.192 | 3.8 Low |
| IVC (clear) [396] | 30.01 | 0.313 | $C_1$ | 0.1268 | 3.957 | 12.6 Mld |
| IVD (clear) [54] | 30.00 | 0.313 | $C_1$ | 0.3231 | 10.083 | 32.2 High |
| IVE (cloudy) [69] | 30.00 | 0.313 | $C_4$ | 0.0818 | 1.104 | 3.5 Low |
| IVF (clear) [306] | 30.01 | 0.313 | $C_4$ | 0.2977 | 4.016 | 12.8 Mid |
| IVG (clear) [320] | 30.00 | 0.313 | $C_4$ | 0.2974 | 4.012 | 12.8 Mid |
| IVH (clear) [586] | 30.01 | 0.313 | $C_4$ | 0.7434 | 10.029 | 32.0 High |
| IVI (cloudy) [65] | 30.00 | 0.313 | $C_{12}$ | 0.1896 | 1.017 | 3.3 Low |
| IVJ (cloudy) [146] | 30.00 | 0.313 | $C_{12}$ | 0.7496 | 4.023 | 12.9 Mid |
| IVK (clear) [259] | 30.01 | 0.314 | $C_{12}$ | 1.8631 | 9.998 | 31.8 High |
| IVL (clear) [268] | 30.00 | 0.313 | $C_{12}$ | 1.8633 | 9.999 | 32.0 High |
| IVM (cloudy) [45] | — | — | none | — | — | 0.00 |

CONTROL 1

CYAN LIQUID DEVELOPER CHARGED WITH AB DIBLOCK QUATERNIZED AMMONIUM BROMIDE CHARGE DIRECTOR WITH NO ADDED ALCOHOL

A cyan liquid toner dispersion was prepared by selecting 27.59 grams of liquid toner concentrate (7.25 percent solids with the ink solids being thermoplastic resin, pigment, and charge adjuvant in NORPAR 15®) from Example I and added to it 162.41 grams of NORPAR 15®, and 10.0 grams of charge director poly(2-ethylhexylmethacrylate-co-N,N,N-trimethyl-N-ethyl methacrylate ammonium bromide) (1.00 percent solids in NORPAR 15®) from Example IV. The preparation of this NORPAR 15® charge director solution without added alcohol is described in Example IV. This preparation resulted in a cyan liquid toner dispersion of 1 percent solids and 50 milligrams of charge director to 1 gram of toner solids, or 5.0 percent charge director per gram of toner solids. The mobility and conductivity of the toner were measured after 1, 3, 7 and 14 days of charging, and were compared to the corresponding values of the 1 percent liquid toners of Example V after the same time periods. The charging and conductivity results for the Control 1 cyan liquid developer and the comparative liquid developers prepared in Example V are presented in Table 3 and the formulations for the developers are provided in Table 2. Both tables are in Example V.

EXAMPLE V

CYAN LIQUID DEVELOPERS CHARGED WITH AB DIBLOCK QUATERNIZED AMMONIUM BROMIDE CHARGE DIRECTORS CONTAINING ADDED ALCOHOLS

Twelve cyan liquid toner dispersions (developers) at 1 percent solids in NORPAR 15® were prepared by mixing the components in Table 2 wherein each alcohol containing charge director described in Table 1 of Example IV was used to charge the cyan liquid toners at a charge director level of 50 milligrams of charge director per gram of toner solid (50/1) or about 5 percent charge director per gram of toner solids.

After charge equilibrating for 1, 3, 7 and 14 days, tests were conducted to determine the charging level and the conductivity of the twelve (Examples IVA through IVL) 1 percent cyan liquid developers now containing low, mid, and high levels of alcohols added from the charge director solutions (Table 1) versus the 1 percent cyan liquid developer containing the same level of the same charge director, but without added alcohols, which also was equilibrated for 1, 3, 7 and 14 days after charging. The results are presented in Table 3 below. The charging levels (mobilities) of the cyan liquid toners (developers) as measured by the indicated ESA mobilities in Examples VA through VL in Table 3, wherein alcohols were first added to the poly(2-ethylhexyl methacrylate-co-N,N,N-trimethyl-N-ethyl methacrylate ammonium bromide) charge director solutions used to charge the liquid toner, exceeded the mobility of the control cyan liquid toner dispersion (Control 1) charged with the same poly(2-ethylhexyl methacrylate-co-N,N,N-trimethyl-N-ethyl methacrylate ammonium bromide) charge director that contained no added alcohol. For each alcohol (C1 or C4 or C12), however, there was an optimum level or range for maximizing charging rate and charging level, while minimizing conductivity to a low level, which is not so low as to decrease charging values. These results indicated that the methyl bromide quaternized ammonium charge directors containing optimum amounts of added alcohols charge cyan liquid toners more rapidly and to a higher charging level when present at the same charge director levels than does the nonalcohol containing same methyl bromide quaternized ammonium charge director in the Control 1 liquid toner.

CONTROL 2

CYAN LIQUID DEVELOPER CHARGED WITH AB DIBLOCK QUATERNIZED AMMONIUM BROMIDE CHARGE DIRECTOR WITH NO ADDED ALCOHOL

A second batch of cyan liquid toner dispersion was prepared as described in Control 1 from the same material sources so that this freshly made Control 2 batch could charge equilibrate for similar time periods as the freshly made Example VI cyan liquid developers. A cyan liquid toner dispersion was prepared by selecting 13.79 grams of liquid toner concentrate (7.25 percent solids with the ink solids being thermoplastic resin, pigment, and charge adjuvant in NORPAR 15®) from Example I and adding to it 181.21 grams of NORPAR 15®, and 5.00 grams of charge director poly(2-ethylhexylmethacrylate-co-N,N,N-trimethyl-N-ethyl methacrylate ammonium bromide) (1.00 percent solids in NORPAR 15®) from Example IVM. The preparation of this NORPAR 15® charge director solution without added alcohol is described in Example IV. This preparation resulted in a cyan liquid toner dispersion of 1 percent solids and 50 milligrams of charge director to 1 gram of toner solids or 5.0 percent charge director per gram of toner solids. No alcohol was present in any component of this developer. The mobility and conductivity of this liquid toner were measured after various time periods up to 39 days of charging and were compared to the corresponding values of the 1 percent liquid toners of Example VI after similar time periods. The charging and conductivity results for the Control 2 cyan liquid developer and the comparative liquid developers prepared in Example VI are presented in Table 5 and the formulations for the developers are provided in Table 4. Both tables are in Example VI.

EXAMPLE VI

CYAN LIQUID DEVELOPERS CHARGED WITH AB DIBLOCK QUATERNIZED AMMONIUM BROMIDE CHARGE DIRECTORS CONTAINING MID-LEVEL n-BUTANOL ADDED AT SPECIFIC TIMES AND LOCATIONS

Four cyan liquid toner dispersions (developers) at 1 percent solids in NORPAR 15® were prepared by mixing the components in Table 4 wherein the charge director without added alcohol prepared in Example IVM and the charge director containing a mid-level of n-butanol prepared in Example IVG (both in Table 1) were used to charge the cyan liquid toners at a charge director level of 50 milligrams of charge director per gram of toner solid (50/1) or about 5 percent charge director per gram of toner solids. The control developer was charged with charge director IVM and contains no added n-butanol. Developer VIA was charged also with charge director IVM for 4 days after which time mid-level n-butanol was added. Developer VIB was charged with Example IVG charge director which also contained mid level n-butanol but the n-butanol was in the charge director solution. In Developer VIC the order of addition was reversed. Developer VIC contained mid-level n-butanol for 4 days prior to charging the dispersion with the charge director. The charge director composition and level, except for the presence or absence of n-butanol, were the same in all the liquid toners of this Example.

After charge equilibrating for up to 35 to 39 days, tests were conducted to determine the charging level and the conductivity of the three experimental (Examples VIA to VIC) 1 percent cyan liquid developers versus the 1 percent cyan liquid developer control containing the same level of the same charge director, but without added n-butanol (Control 2) which was equilibrated for similar time periods after charging. The results are presented in Table 5 below.

The primary purpose of the experiment described in Example VI was to determine the n-butanol addition mode that was most effective in promoting developer charging (as measured by ESA mobility) versus the control developer which contained no n-butanol. Inspection of Table 5 indicates that the most effective n-butanol addition mode to make useful liquid toner was (Example VIB) the addition of n-butanol to the charge director solution prior to charging the liquid toner dispersion with said n-butanol-charge director solution.

TABLE 2

FORMULATIONS FOR THE CYAN LIQUID DEVELOPERS IN CONTROL 1 AND EXAMPLE V

| Example: Developer Number | Grams Toner Concent. from Example I | Grams Added NORPAR 15 | Grams Added 1% Charge Director [50 mg/g] | Charge Director Example and Alcohol Level in CD Solution |
|---|---|---|---|---|
| VA | 27.59 | 162.41 | 10.00 | Example IVA - Low |
| VB | 27.59 | 162.41 | 10.00 | Example IVB - Low |
| VC | 27.59 | 162.41 | 10.00 | Example IVC - Mid |
| VD | 27.59 | 162.41 | 10.00 | Example IVD - High |
| VE | 27.59 | 162.41 | 10.00 | Example IVE - Low |
| VF | 27.59 | 162.41 | 10.00 | Example IVF - Mid |
| VG | 27.59 | 162.41 | 10.00 | Example IVG - Mid |
| VH | 27.59 | 162.41 | 10.00 | Example IVH - High |
| VI | 27.59 | 162.41 | 10.00 | Example IVI - Low |
| VJ | 27.59 | 162.41 | 10.00 | Example IVJ - Mid |
| VK | 27.59 | 162.41 | 10.00 | Example IVK - High |
| VL | 27.59 | 162.41 | 10.00 | Example IVL - High |
| Control 1 | 27.59 | 162.41 | 10.00 | Example IVM - None |

TABLE 3

| Example: Developer Number | CD Equilibration Time in Days [50 mg/g] | Mobility $E^{-10}$ $m^2/Vs$ | Cond. ps/cm | Alcohol & Level From CD Solution | Comments: Charging and Conductivity |
|---|---|---|---|---|---|
| Control 1 | 1 | −1.11 | 2 | None | Slow Charge-Up |
| | 3 | −0.60 | 1 | | Followed by Rapid |
| | 7 | −0.42 | 1 | | Charge Decay; |
| | 14 | −0.28 | 1 | | Very Low |
| | | | | | Conductivity |
| VA | 1 | −2.63 | 9 | Methanol | Rapid Charge-Up |
| | 3 | −2.61 | 9 | Low Level | and Very High |
| | 7 | −2.80 | 8 | | Charge Level; |
| | 14 | −2.84 | 8 | | Moderate |
| | | | | | Conductivity |
| VB | 1 | −2.65 | 10 | Methanol | Rapid Charge-Up |
| | 3 | −2.77 | 10 | Low Level | and Very High |
| | 7 | −2.62 | 10 | | Charge Level; |
| | 14 | −2.77 | 9 | | Moderate |
| | | | | | Conductivity |
| VC | 1 | −2.71 | 13 | Methanol | Rapid Charge-Up |
| | 3 | −2.33 | 13 | Mid Level | and Very High |
| | 7 | −2.85 | 12 | | Charge Level; |
| | 14 | −2.81 | 12 | | Moderate |
| | | | | | Conductivity |
| VD | 1 | −2.38 | 7 | Methanol | Rapid Charge-Up |
| | 3 | −2.31 | 7 | High Level | and High Charge |
| | 7 | −2.64 | 6 | | Level; |
| | 14 | −2.41 | 6 | | Low Conductivity |
| VE | 1 | −1.70 | 3 | n-Butanol | Moderate Charge- |
| | 3 | −1.77 | 3 | Low Level | Up Followed by |
| | 7 | −1.82 | 2 | | Slow Charge |
| | 14 | −1.31 | 2 | | Decay; Low |
| | | | | | Conductivity |
| VF | 1 | −2.28 | 12 | n-Butanol | Rapid Charge-Up |
| | 3 | −2.53 | 11 | Mid Level | and High Charge |
| | 7 | −2.68 | 11 | | Level; Moderate |
| | 14 | −2.56 | 10 | | Conductivity |
| VG | 1 | −2.42 | 13 | n-Butanol | Rapid Charge-Up |
| | 3 | −2.53 | 12 | Mid Level | and High Charge |
| | 7 | −2.53 | 12 | | Level; Moderate |
| | 14 | −2.64 | 11 | | Conductivity |
| VH | 1 | −2.38 | 17 | n-Butanol | Rapid Charge-Up |
| | 3 | −2.30 | 16 | High Level | and High Charge |
| | 7 | −2.45 | 15 | | Level; High |
| | 14 | −2.47 | 14 | | Conductivity |
| VI | 1 | −1.15 | 2 | n-Dodecanol | Slow Charge-Up |
| | 3 | −1.02 | 2 | Low Level | Followed by Slow |
| | 7 | −1.25 | 2 | | Charge Decay; Low |
| | 14 | −0.91 | 2 | | Conductivity |
| VJ | 1 | −2.20 | 6 | n-Dodecanol | Rapid Charge-Up |
| | 3 | −2.04 | 5 | Mid Level | and High Charge |
| | 7 | −2.60 | 5 | | Level; Low |

TABLE 3-continued

| Example: Developer Number | CD Equilibration Time in Days [50 mg/g] | Mobility $E^{-10}$ $m^2/Vs$ | Cond. ps/cm | Alcohol & Level From CD Solution | Comments: Charging and Conductivity |
|---|---|---|---|---|---|
| | 14 | −2.38 | 5 | | Conductivity |
| VK | 1 | −2.32 | 12 | n-Dodecanol | Rapid Charge-Up |
| | 3 | −2.30 | 12 | High Level | and High Charge |
| | 7 | −2.70 | 11 | | Level; Moderate |
| | 14 | −2.60 | 11 | | Conductivity |
| VL | 1 | −2.36 | 12 | n-Dodecanol | Rapid Charge-Up & |
| | 3 | −2.54 | 11 | High Level | High Charge Level; |
| | 7 | −2.64 | 11 | | Moderate |
| | 14 | −2.62 | 10 | | Conductivity |

TABLE 4

FORMULATIONS FOR THE CYAN LIQUID DEVELOPERS IN CONTROL 2 AND EXAMPLE VI

| Example Number of Developer | Grams Toner Concentrate from Example I | Grams Added NORPAR 15 | Grams Added 1% (CD) Charge Director [50 mg/g] | Grams Added n-Butanol | n-Butanol Addition Mode |
|---|---|---|---|---|---|
| VIA | 13.79 | 181.21 | 5.00 of Ex. IVM CD | 0.049 | n-Butanol Added to Developer 4 Days After CD |
| VIB | 13.79 | 181.21 | 5.00 of Ex. IVG CD | 0.049 | n-Butanol & CD Combined and Added at Time Zero to Developer |
| VIC | 13.79 | 181.21 | 5.00 of Ex. IVM CD | 0.049 | n-Butanol Added to Developer 4 Days Before CD |
| Control 2 | 13.79 | 181.21 | 5.00 of Ex. IVM CD | None | No Added Butanol |

TABLE 5

CHARGING AND CONDUCTIVITY CHARACTERIZATION FOR CYAN LIQUID DEVELOPERS IN CONTROL 2 AND EXAMPLE VI

| Example: Developer Number | CD Equilibration Time in Days [50 mg/g] | Mobility $E^{-10}$ $m^2/Vs$ | Cond. ps/cm | Comments: Charging and Conductivity |
|---|---|---|---|---|
| Control 2 | 4 | −0.61 | 1 | Absence of Added Alcohol |
| | 5 | −0.29 | 3 | as in Control 1 of Example |
| | 11 | −0.25 | 1 | V Gives Slow Charging |
| | 18 | −0.23 | 1 | Rate and Low Charging |
| | 39 | −0.27 | 1 | Level and Low Conductivity |
| VIA | 4 (before) | −0.58 | 1 | Addition of n-Butanol 4 |
| | 15 min. | −0.80 | 1 | Days After the Addition of |
| | 1 | −0.28 | 2 | the CD is Ineffective in |
| | 3 | −0.50 | 1 | Increasing Charging or |
| | 7 | −0.44 | 1 | Conductivity to Useful |
| | 14 | −0.29 | 1 | Levels; Charge Decay to |
| | 35 | −0.24 | 1 | Low Charging Level & Low Conductivity Remain as in Control 2 Above |
| VIB | 4 | −2.58 | 7 | Charging Rate and Level |
| | 5 | −2.02 | 9 | High as in Example VG; |
| | 7 | −2.58 | 7 | Conductivity Remains Low; |
| | 11 | −2.66 | 7 | Combined Presence of n- |
| | 18 | −2.56 | 6 | Butanol and CD are Most |
| | 39 | −2.57 | 6 | Effective in Producing Useful Toner |
| VIC | 4 (before) | −0.50 | 1 | Addition of n-Butanol 4 |
| | 15 min. | −1.61 | 3 | Days Before the Addition |

TABLE 5-continued

CHARGING AND CONDUCTIVITY CHARACTERIZATION FOR CYAN LIQUID DEVELOPERS IN CONTROL 2 AND EXAMPLE VI

| Example: Developer Number | CD Equilibration Time in Days [50 mg/g] | Mobility $E^{-10}$ $m^2/Vs$ | Cond. ps/cm | Comments: Charging and Conductivity |
|---|---|---|---|---|
| | 1 | −1.42 | 5 | of the CD is Slightly Less |
| | 3 | −1.83 | 4 | Effective vs. 6B but Much |
| | 7 | −2.05 | 3 | More Effective vs. 6A in |
| | 14 | −2.10 | 3 | Producing Useful Toner |
| | 35 | −2.00 | 2 | |

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer consisting essentially of a liquid, thermoplastic resin particles, pigment, and a charge director containing an alcohol, and wherein said alcohol is selected from the group consisting of methanol, ethanol, propanol, butanol, and pentanol.

2. A developer in accordance with claim 1 wherein the resin particles are comprised of a copolymer of ethylene and an α,β-ethylenically unsaturated acid selected from the group consisting of acrylic acid and methacrylic acid.

3. A developer in accordance with claim 1 wherein the pigment is cyan, magenta, yellow, red, green, blue, brown, or mixtures thereof, or carbon black.

4. A developer in accordance with claim 1 with a conductivity of from about 5 to about 20 ps/cm for a developer of about 1 percent solids.

5. A liquid developer consisting essentially of a nonpolar liquid, thermoplastic resin particles, a charge adjuvant, and a charge director containing an aliphatic alcohol, and wherein said alcohol is selected from the group consisting of methanol, ethanol, propanol, butanol, and pentanol.

6. A developer in accordance with claim 5 wherein the resin particles are comprised of a styrene polymer, an acrylate polymer, a methacrylate polymer, a polyester, or mixtures thereof.

7. A developer in accordance with claim 5 wherein the pigment is cyan, magenta, yellow, red, green, blue, brown, or mixtures thereof, or carbon black.

8. A liquid developer in accordance with claim 5 wherein the charge adjuvant is aluminum stearate or magnesium stearate.

9. A liquid electrostatographic developer comprised of (A) a nonpolar liquid having a Kauri-butanol value of from about 5 to about 30 and present in a major amount of from about 50 percent to about 95 weight percent; (B) thermoplastic resin particles having an average volume particle diameter of from about 5 to about 30 microns; (C) a charge director aliphatic alcohol mixture; and (D) a charge adjuvant, and wherein said aliphatic alcohol is selected from the group consisting of methanol, ethanol, propanol, butanol, pentanol, hexanol, heptanol, octanol, nonanol, decanol, dodecanol, hexadecanol, and octadecanol.

10. A developer in accordance with claim 9 wherein the charge director is represented by the formula

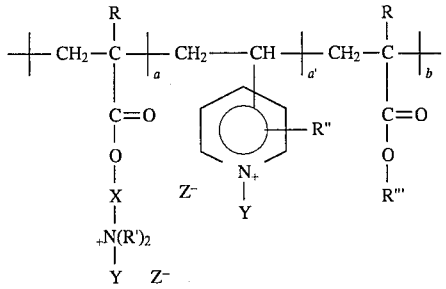

wherein R is hydrogen, alkyl, aryl, or alkylaryl; R" is, alkyl, aryl, cycloalkyl, cycloalkylalkyl, cycloalkylaryl or alkylaryl with or without heteroatoms; R''' is alkyl, aryl, cycloalkyl, cycloalkylalkyl, cycloalkylaryl or alkylaryl of 4 to 20 carbons with or without heteroatoms; X is alkylene or arylalkylene of about 2 to 10 carbons with or without heteroatoms and Y is hydrogen, alkyl of 1 to about 25 carbon atoms; alkylaryl and aryl from 6 to about 30 carbon atoms with or without heteroatoms; Z− is an anion of bromide, hydroxide, chloride, nitrate, p-toluenesulfonate, sulfate, phosphate, fluoride, dodecylsulfonate, dodecylbenzenesulfonate, acetate, trifluoracetate, chloroacetate, or stearate; $aM_a+a'M_{a'}$ is about 200 to 120,000 and $bM_b$ is 2,000 to 190,000 wherein a,a', and b is the number average degree of polymerization (DP); and $M_a$, $M_{a'}$ and $M_b$ are the corresponding repeat unit molecular weights.

11. A developer in accordance with claim 10 wherein the charge director is an ABA triblock copolymer.

12. A developer in accordance with claim 10 wherein alkyl contains from 1 to about 25 carbon atoms; aryl contains from 6 to about 24 carbon atoms; and alkylene contains from 1 to about 25 carbon atoms.

13. A developer in accordance with claim 9 wherein the charge adjuvant is aluminum stearate, or aluminum di(di-t-butylsalicylate).

14. A developer in accordance with claim 9 wherein the resin is comprised of a copolymer of ethylene and vinyl acetate, polypropylene, polyethylene or acrylic polymers.

15. A developer in accordance with claim 9 wherein the resin is comprised of a copolymer of ethylene, and acrylic or methacrylic acid, an alkyl ester of acrylic or methacrylic acid wherein alkyl contains from 1 to about 5 carbon atoms or a copolymer of ethylene, and methacrylic acid with a melt index at 190° C. of 500.

16. A developer in accordance with claim 9 wherein the pigment is cyan, magenta, yellow, red, green, blue, brown, or mixtures thereof, or carbon black.

17. A developer in accordance with claim 9 wherein the charge director is present in an amount of from about 2 to about 10 weight percent.

18. A developer in accordance with claim 9 wherein component (A) is present in an amount of from 85 percent to 99.9 percent by weight based on the total weight of the developer solids of resin, pigment, and charge adjuvant which is present in an amount of from about 0.1 percent to about 15 percent by weight; and component (C) is present in an amount of from about 0.25 to about 1,500 milligrams/gram of the developer solids comprised of resin, pigment, and charge adjuvant.

19. A developer in accordance with claim 9 wherein component (D) is present in an amount of 0.1 to 40 percent by weight based on the total weight of developer solids.

20. A developer in accordance with claim 9 wherein the liquid is an aliphatic hydrocarbon.

21. A developer in accordance with claim 20 wherein the aliphatic hydrocarbon is a mixture of branched hydrocarbons with from about 10 to about 20 carbon atoms.

22. A developer in accordance with claim 20 wherein the aliphatic hydrocarbon is a mixture of normal hydrocarbons with from about 10 to about 20 carbon atoms.

23. A developer in accordance with claim 9 wherein the resin is an alkylene polymer, a styrene polymer, an acrylate polymer, a polyester, or mixtures thereof.

24. A developer in accordance with claim 9 wherein the charge director is selected from the group consisting of poly[2-trimethylammoniumethyl methacrylate hydroxide co-2-ethylhexyl methacrylate], poly[2-triethylammoniumethyl methacrylate hydroxide co-2-ethylhexyl methacrylate], poly[2-trimethylammoniumethyl methacrylate hydroxide co-2-ethylhexyl methacrylate], poly[2-trimethylammoniumethyl methacrylate hydroxide co-2-ethylhexyl acrylate], poly[2-trimethylammoniumethyl acrylate hydroxide co-2-ethylhexyl methacrylate], poly[2-trimethylammoniumethyl acrylate hydroxide co-2-ethylhexyl acrylate], poly[2-trimethylammoniumethyl methacrylate hydroxide co-2-ethylhexyl acrylate], poly[2-triethylammoniumethyl acrylate hydroxide co-2-ethylhexyl acrylate], poly[2-triethylammoniumethyl methacrylate hydroxide co-2-ethylhexyl acrylate], poly[2-trimethylammoniumethyl acrylate hydroxide co-2-ethylhexyl acrylate], poly[2-trimethylammoniumethyl methacrylate hydroxide co-N,N-dibutyl methacrylamide], poly[2-triethylammoniumethyl methacrylate hydroxide co-N,N-dibutyl methacrylamide], poly[2-trimethylammoniumethyl methacrylate hydroxideco-N,N-dibutylacrylamide], and poly[2-triethylammoniumethyl methacrylatehydroxide co-N,N-dibutylacrylamide].

25. A developer in accordance with claim 9 wherein the charge director is selected from the group consisting of poly[2 -dimethylammoniumethyl methacrylate bromide co-2-ethylhexyl methacrylate], poly[2-dimethylammoniumethyl methacrylate tosylate co-2 -ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2 -dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2 -ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2 -dimethylammoniumethyl methacrylate bromide co-N,N-dibutylacrylamide], and poly[2-dimethylammoniumethyl methacrylate tosylate co-N,N-dibutylacrylamide].

26. A developer in accordance with claim 9 wherein the alcohol is present in an amount of from about 2 to 100 millimoles of alcohol per mole of ammonium group contained in the charge director.

27. A developer in accordance with claim 9 wherein the alcohol is present in an amount of from 3 to 20 millimoles of alcohol per mole of ammonium group in the charge director.

28. A developer in accordance with claim 9 with a conductivity of from about 5 to about 20 ps/cm for a developer of 1 percent solids.

29. A developer in accordance with claim 9 wherein the charge director is represented by the formula

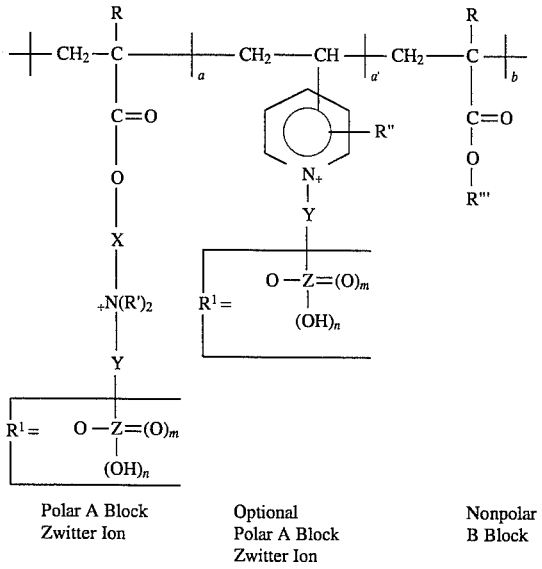

wherein R is hydrogen, alkyl, aryl, or alkylaryl; $R^1$ is a conjugate oxygen containing acid anion derived from carbon, sulfur, or phosphorus; Z is carbon (C), sulfur (S), phosphorus (P), or substituted phosphorus; m is 1 or 2 doubly bonded oxygen atoms; n is 0 or 1 hydroxyl groups; R' is alkyl, aryl, cycloalkyl, cycloalkylenyl cycloalkylalkyl, cycloalkylaryl or alkylaryl; R" is alkyl, aryl, cycloalkyl, cycloalkylalkyl, cycloalkylaryl or alkylaryl; R'" is alkyl, aryl, cycloalkyl, cycloalkylalkyl, cycloalkylaryl or alkylaryl of 4 to 20 carbons; X is alkylene or arylalkylene of from about 2 to 10 carbons; Y is alkylene or arylalkylene of 1 to 10 carbons with or without heteroatoms; $aM_a+a'M_{a'}$ is about 200 to 120,000; and $bM_b$ is 2,000 to 190,000 wherein a,a', and b is the number average degree of polymerization (DP); and $M_a$, $M_{a'}$, and $M_b$ is the corresponding repeat unit molecular weights.

30. A method for increasing the conductivity of a liquid developer which consists essentially of adding to the toner components of resin, pigment, and charge additive a mixture of a charge director and an aliphatic alcohol, and wherein said aliphatic alcohol is selected from the group consisting of methanol, propanol, butanol, pentanol, hexanol, heptanol, octanol, nonanol, decanol, dodecanol, hexadecanol, and octadecanol.

31. A method in accordance with claim 30 wherein the conductivity increases from about 1 to about 10 ps/cm.

32. A process for the preparation of a liquid developer consisting essentially of initially forming a mixture of charge director and an aliphatic alcohol, and thereafter adding this mixture to a composition comprised of resin, pigment, and charge adjuvant, and which developer possesses excellent clarity and a charge as measured by ESA mobility ranging from about 1.5 E-10 $m^2/Vs$ to about 4.0 E-10 $m^2/Vs$, and wherein said aliphatic alcohol is selected from the group consisting of methanol, propanol, butanol, pentanol, hexanol, heptanol, octanol, nonanol, decanol, dodecanol, hexadecanol, and octadecanol.

33. A process for the preparation of a liquid developer consisting essentially of initially forming a composition comprised of resin, pigment, and charge additive, and thereafter adding thereto a mixture of charge director and an aliphatic alcohol, which developer possesses excellent clarity and a charge as measured by ESA mobility ranging from about 1.5 E-10 $m^2/Vs$ to about 4.0 E-10 $m^2/Vs$, and wherein said aliphatic alcohol is selected from the group consisting of methanol, propanol, butanol, pentanol, hexanol, heptanol, octanol, nonanol, decanol, dodecanol, hexadecanol, and octadecanol.

34. An imaging method which comprises forming an electrostatic latent image followed by the development thereof with the liquid developer of claim 5.

35. An imaging method which comprises forming an electrostatic latent image followed by the development thereof with the liquid developer of claim 9.

36. A liquid developer consisting of a liquid, thermoplastic resin particles, pigment, and a charge director containing an alcohol, and wherein said alcohol is selected from the group consisting of methanol, propanol, butanol, pentanol, hexanol, heptanol, octanol, nonanol, decanol, dodecanol, hexadecanol, and octadecanol.

* * * * *